US006652125B1

(12) United States Patent
Kirsten et al.

(10) Patent No.: US 6,652,125 B1
(45) Date of Patent: Nov. 25, 2003

(54) INTERIOR LUMINAIRE, IN PARTICULAR FOR THE ILLUMINATION OF MERCHANDISE DISPLAY SURFACE

(75) Inventors: Martin Kirsten, Burscheid (DE); Bernhard Schutte, Langenfeld (DE)

(73) Assignee: BA★RO GmbH & Co. KG, Leichlingen (DE)

( * ) Notice: Subject to any disclaimer, the term of this patent is extended or adjusted under 35 U.S.C. 154(b) by 0 days.

(21) Appl. No.: 10/167,085

(22) Filed: Jun. 12, 2002

(30) Foreign Application Priority Data

Jun. 13, 2001 (EP) ..... 1114322

(51) Int. Cl.[7] ..... F21V 7/00

(52) U.S. Cl. ..... 362/307; 362/92; 362/311; 362/355; 362/301

(58) Field of Search ..... 362/307, 308, 362/311, 355, 267, 351, 350, 300, 301, 306, 92

(56) References Cited

U.S. PATENT DOCUMENTS 4,974,137 A * 11/1990 Evans et al. ..... 362/300
5,467,259 A * 11/1995 Hume et al. ..... 362/307
5,758,958 A * 6/1998 Chen ..... 362/307
2001/0050344 A1 * 12/2001 Albou ..... 250/504 R

* cited by examiner

*Primary Examiner*—Sandra O'Shea
*Assistant Examiner*—John Anthony Ward
(74) *Attorney, Agent, or Firm*—Liniak, Berenato & White, LLC

(57) ABSTRACT

The invention describes an interior luminaire, in particular for the illumination of merchandise display surfaces, having a transparent luminaire shade (2) and an optical system (5, 6) with a light-emitting means (5), which is characterized in that the optical system (5, 6) is positioned in a light-emitting means space (3) provided above the luminaire shade (2) and radiates light into the luminaire shade through a light entry opening (2*a*) on the upper side thereof; and that an inwardly projecting, diffusely reflecting flange (9), which reflects at least a portion of the emerging light back into the luminaire shade (2), is provided at the lower rim of the luminaire shade (2).

12 Claims, 1 Drawing Sheet

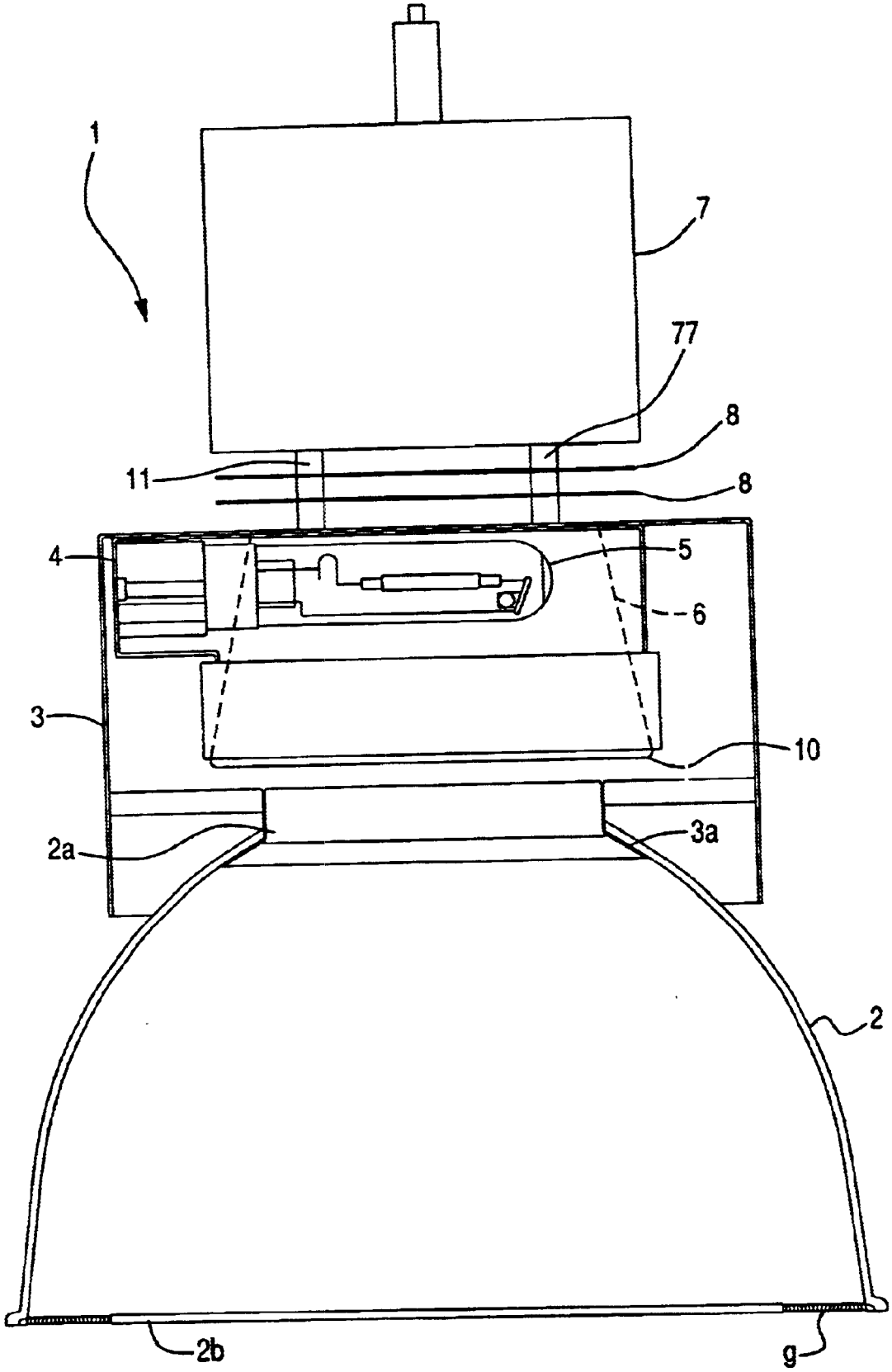
1
7
77
8
11
8
4
5
6
3
10
2a
3a
2
2b
g

INTERIOR LUMINAIRE, IN PARTICULAR FOR THE ILLUMINATION OF MERCHANDISE DISPLAY SURFACE

The present invention concerns an interior luminaire, in particular for the illumination of merchandise display surfaces, having a transparent luminaire shade and an optical system with a light-emitting means.

Merchandise display surfaces, for example refrigerator cases, fruit bins, retail shelves, etc., are usually artificially illuminated. The goal is to illuminate the surfaces as homogeneously as possible. Interior luminaires of the kind cited above having transparent luminaire shades are used, for example, for this purpose. These conventional interior luminaires have the disadvantage that they generate a dazzle effect, since the light-emitting means is visible externally as a particularly bright point or surface. The interior luminaires moreover possess only a small degree of light deflection, with the result that only a small portion of the lamp's luminous flux actually strikes the usable area that is to be illuminated. In addition, vertical light-emitting means and rotationally symmetrical reflectors, which each generate a circular illuminating surface, are often used in such interior luminaires. This results in the disadvantage that high peak illumination intensities are produced at the center of the circle, with the result that the merchandise items can become faded and bleached; and moreover, with wide light distributions, a large portion of the circular light cone falls not on the sales fixture but into the customer and service area. The result is poor efficiency in terms of usable illumination.

Luminaires having a horizontal light-emitting means, which generate oval illuminating surfaces, are therefore alternatively used. These luminaires having a horizontal light-emitting means do represent an improvement for the illumination of elongated display surfaces, but the luminaire shade is still inhomogeneously illuminated.

It is therefore the object of the invention to configure an interior luminaire of the kind cited initially in such a way that the luminaire shade is homogeneously illuminated and, in particular, that dazzle effects are eliminated.

This object is achieved, according to the present invention, in that the optical system is positioned in a light-emitting means space provided above the luminaire shade and radiates light into the luminaire shade through a light entry opening on the upper side thereof, and that an inwardly projecting, diffusely reflecting flange, which reflects at least a portion of the emerging light back into the luminaire shade, is provided at the lower rim of the luminaire shade.

With the known interior luminaires the problem existed, as already described, that the light-emitting means was clearly visible to an observer through the transparent shade as a bright area. According to the present invention this is now avoided by the fact that the light-emitting means is housed outside the lamp shade in the light-emitting means space, with the consequence that a homogeneous illumination of the lamp shade is achieved.

This effect is even further reinforced by the fact that at the flange which is provided at the light exit opening of the lamp shade, a portion of the emerging light is reflected back into the lamp shade, i.e. additionally brightens it.

According to a further embodiment of the invention, the luminaire shade is made of light-transmissive material, for example an acrylic material, that has total-reflection properties as a result of its surface structure. Homogeneous illumination of the lamp shade is further assisted by this surface structure.

In order to optimize homogeneous illumination of the luminaire shade, the latter can furthermore be configured and mounted in a light-emitting means space in such a way that a portion of the light radiated by the optical system enters directly into the material of the luminaire shade.

According to a further embodiment, provision is made for the light-emitting means to be a high-pressure discharge lamp in a horizontal operating position. The use of such high-pressure discharge lamps makes possible the concentrated generation of high light fluxes, and thus high power conversion in a small space. The use of such light-emitting means in a horizontal operating position, optionally in combination with corresponding reflectors that generate, for example, a bat-wing light intensity distribution, furthermore allows elongated areas to be illuminated homogeneously, so that the number of luminaires necessary for illumination of a long display area can be minimized.

The ballast units necessary when high-pressure discharge lamps of this kind are used can be provided, for example, in an operating equipment space, provided adjacent to the light-emitting means space and in particular above the latter, that is thermally insulated from the light-emitting means space so that the ballast units are not negatively is affected by the heat evolved by the light-emitting means during operation. For example, heat shields can be provided between the light-emitting means space and the operating equipment space.

In addition, the flange at the lower rim of the luminaire shield can be partially light-transmissive and can diffusely scatter the light that passes through. For example, the flange as well as the lamp shade can be made of an acrylic material.

Lastly, the flange can be selectively reflective in order to filter out specific color components. In the same fashion, the light entry opening of the luminaire shade can have in front of it a filter that filters specific color components out of the light emitted by the light-emitting means, in order to emphasize complementary colors.

As regards further advantageous embodiments of the invention, the reader is referred to the dependent claims and to the description below of an exemplary embodiment with reference to the appended drawings.

In the drawings, the single FIGURE shows an interior luminaire according to the present invention in a schematic cross-sectional view. Interior luminaire 1, which can be used in particular for the illumination of elongated areas such as freezer cases, fruit bins, retail shelves, etc., comprises a round luminaire shade 2 made of a transparent acrylic material which has at its upper end a smaller light entry opening 2*a* and at its lower end a larger light exit opening 2*b*. Luminaire shade 2 is mounted below light-emitting means space 3 with an extension 3*a*, and light enters the luminaire shade through light entry opening 2*a*. A box reflector 6 of ordinary design, which is open at its underside that faces toward light entry opening 2*a* of luminaire shade 2, is retained in light-emitting means space 3. A high-pressure discharge lamp 5, which is inserted into a corresponding lamp is socket 4, is arranged in a horizontal operating position inside reflector 6. High-pressure discharge lamp 5 can be configured, for example, as a metal halogen vapor lamp or as a high-pressure sodium lamp with improved color rendition.

An operating equipment space 7, in which the ballast units for high-pressure discharge lamp 5 are housed, is provided above light-emitting means space 3. Light-emitting means space 3 and operating equipment space 7 are thermally insulated from one another. Two heat shields 8 are provided for that purpose between the two spaces 3, 7.

In the exemplary embodiment depicted, a filter 10, which filters specific color components out of the light before it enters lamp shade 2, is provided at the open underside of reflector 6. Alternatively or additionally, the surface of reflector 6 can also be selectively reflective.

An annular flange 9, which projects into light exit opening 2*b* and delimits it, is provided at the lower rim of luminaire shade 2. This flange 9 is made of a partly reflective and partly diffusely scattering material, for example acrylic.

In operation, the light produced by high-pressure discharge lamp 5, optionally after reflection at reflector 6, enters luminaire shade 2 through light entry opening 2*a*, in which context specific color components are filtered out by filter 10. A portion of the light entering luminaire shade 2 strikes luminaire shade 2 and/or flange 9, where it either is diffusely reflected back into luminaire shade 2 or emerges in diffusely scattered fashion. As a result of the reflections that occur and the diffuse light scattering upon exit, homogeneous illumination of luminaire shade 2 is achieved. In particular, the result of the placement of light-emitting means 5 in light-emitting means space 3 outside luminaire shade 2 is that light-emitting means 5 itself is not directly visible to an observer, and in particular does not appear as a bright spot in the lamp shade.

What is claimed is:

1. An interior luminaire, in particular for the illumination of merchandise display surfaces, having a transparent luminaire shade (2) and an optical system (5, 6) with a light-emitting means (5), wherein the optical system (5, 6) is positioned in a light-emitting means space (3) provided above the luminaire shade (2) and radiates light into the luminaire shade through a light entry opening (2*a*) on the upper side thereof; and an inwardly projecting, diffusely reflecting flange (9), which reflects at least a portion of the emerging light back into the luminaire shade (2), is provided at the lower rim of the luminaire shade (2).

2. The interior luminaire as defined in claim 1, wherein the optical system (5, 6) comprises a reflector (6) which reflects toward the light entry opening (2*a*) of the luminaire shade (2) light that is emitted upward or to the side by the light-emitting means (5).

3. The interior luminaire as defined in claim 1, wherein the light-emitting means is a high-pressure discharge lamp (5) in a horizontal operating position.

4. The interior luminaire as defined in claim 1, wherein the light-emitting means space (3) is embodied as a luminaire dome.

5. The interior luminaire as defined in claim 1, wherein the luminaire shade (2) is made of light-transmissive material that has total-reflection properties as a result of its surface structure.

6. The interior luminaire as defined in claim 5, wherein the luminaire shade (2) is made of a transparent plastic material.

7. The interior luminaire as defined in claim 1, wherein the luminaire shade (2) is round.

8. The interior luminaire as defined in claim 1, wherein the luminaire shade (2) is configured and mounted on the light-emitting means space (3) in such a way that a portion of the light emitted by the optical system (5, 6) enters directly into the material of the luminaire shade (2) in order to illuminate it.

9. The interior luminaire as defined in claim 1, wherein an operating equipment space (7), provided adjacent to the light-emitting means space (3) and in particular above the light-emitting means space (3), is provided for the reception of ballast units of the light-emitting means (5); and the operating equipment space (7) is thermally insulated from the light-emitting means space (3).

10. The interior luminaire as defined in claim 9, wherein heat shields (8) are provided between the light-emitting means space (3) and the operating equipment space (7).

11. The interior luminaire as defined in claim 1, wherein the flange (9) at the lower rim of the luminaire shield (2) is partially light-transmissive and diffusely scatters the light that passes through.

12. The interior luminaire as defined in claim 1, wherein the flange (9) is selectively reflective.

* * * * *